US005556134A

United States Patent [19]

Barnette

[11] Patent Number: 5,556,134

[45] Date of Patent: Sep. 17, 1996

[54] SELF-SEALING COVER FOR DUST JACKETS

[75] Inventor: Charles J. Barnette, Akron, Ohio

[73] Assignee: Kent Adhesive Products Co., Kent, Ohio

[21] Appl. No.: 319,923

[22] Filed: Oct. 7, 1994

[51] Int. Cl.[6] ..... B42D 3/00; B42D 3/02

[52] U.S. Cl. ..... 281/29; 281/15.1; 281/21.1; 281/34; 156/227

[58] Field of Search ..... 281/29, 34, 15.1, 281/21.1, 19.1; 428/40; 156/226, 227, 247, 249, 289

[56] References Cited

U.S. PATENT DOCUMENTS

| | | | |
|---|---|---|---|
| 3,572,767 | 3/1971 | Learned et al. | 281/34 |
| 3,891,240 | 6/1975 | Du Corday | 281/29 |
| 4,341,401 | 7/1982 | Arntzen | 281/34 |
| 4,511,298 | 4/1985 | Jones | 402/75 X |
| 4,744,592 | 5/1988 | Barnette et al. | 281/29 X |
| 4,762,341 | 8/1988 | Rabuse | 281/29 |
| 4,886,299 | 12/1989 | Ducorday | 281/31 |
| 4,893,837 | 1/1990 | Pugliese et al. | 281/31 |
| 5,087,078 | 2/1992 | Phillips | 281/31 |
| 5,183,295 | 2/1993 | Barnette | 281/29 |

*Primary Examiner*—Frances Han

*Attorney, Agent, or Firm*—Renner, Kenner, Greive, Bobak, Taylor & Weber

[57] ABSTRACT

A cover for a dust jacket that protects a bookcover is provided with a substantially clear film which has spaced apart longitudinal edges, with an exterior surface opposite an interior surface, a plurality of paper strips with an exterior side and an adhesion side which has a pressure sensitive adhesive disposed thereon, the adhesion side having a film edge complementary with a strip edge, the film edge is bonded to the exterior surface of the longitudinal edge of the film, and a release material correspondingly disposed on the strip edges. The present invention also includes a method for affixing the cover to a dust jacket that protects a bookcover.

19 Claims, 2 Drawing Sheets

SELF-SEALING COVER FOR DUST JACKETS

TECHNICAL FIELD

The invention herein resides generally in the art of protective covers for books, pamphlets, booklets and similar materials. More particularly, the present invention relates to protective covers for book dust jackets. Specifically, the present invention relates to self-sealing protective covers that have longitudinal edges made of paper for easy handling and application to dust jackets.

BACKGROUND ART

Since the advent of the written language, people have recorded their thoughts and ideas in writing, usually on some form of paper. Typically, these thoughts would be written on one continuous roll of paper in the form of a scroll, or on individual pieces of paper which would be bound together in the form of a book. To protect these bound collections of paper, the authors or transcribers would enclose the bound papers within some type of rigid structure such as a cover. Typically, these bookcovers would be made of thin layers of wood enclosed in some type of cloth or leather. Furthermore, the title and author of the writing would be written or embossed on the bookcover. Unfortunately, these bookcovers had a tendency to become worn and dusty, thereby presenting an unpleasant appearance.

Even today bookcovers which are mass produced for retail sale and for use in public libraries are likely to become dusty and worn. Publishers provide dust jackets to further enhance the appearance of these bookcovers. In addition to identifying the author and the title of the work on the dust jacket, publishers often include multi-color graphics, testimonials, and a synopsis of the contents of the book. However, these dust jackets also undergo much wear and tear when the books are frequently used. This is especially true for those books maintained in schools and public libraries.

At the request of librarians, special materials have been developed to protect the integrity of dust jackets. Typically, these covers for dust jackets protect against migrant acid, heavy use, tearing, liquids and dirt that may severely damage the dust jacket and bookcover. It is also known to use polyester film for these covers so as to reduce glare and protect the dust jackets from ultraviolet light.

Several different products have been developed to meet this need of coveting dust jackets for books. Known covers for dust jackets range from those designed for specific heights and lengths, which are sometimes difficult to assemble, and those which are adaptable to various sizes. A first type of cover is called a center slit cover which is provided in predetermined widths with overlapping edges such that the cover is provided on rolls. The center slit cover is unrolled and cut to the same length as the dust jacket. The dust jacket is then inserted into the center slit cover which is then refolded onto the bookcover. Typically, the center slit cover is not permanently attached to the dust jacket and has a white backing used for the overlapping flaps and a clear film front such that the information contained on the dust jacket is presented as intended by the publisher. Another type of cover for dust jackets provided in rolls is the end slit construction. The end slit construction has a white backing and a clear film front. After the end slit cover is cut to length, the dust jacket is inserted therein and then refolded over the bookcover. Again, no permanent attachment is made between the end slit cover and the dust jacket.

Other variations of covers for dust jackets include those where the cover is completely folded over and around the dust jacket, after which the cover is affixed to itself. One variation of this is where two telescoping covers are placed over the dust jacket and then taped to one another so as to enclose the dust jacket. This variation allows for easy adjustment of the cover to the width of the dust jacket without having to store numerous sizes of covers as required by the center slit and end slit cover variations.

Although the aforementioned covers for dust jackets are effective in reducing the wear and tear thereof, they still have several drawbacks. Primarily, the center slit and end slit covers are not easily adaptable to different size dust jackets. As such, various lengths and widths of covers must be stored in order to cover the various sizes of books that are available. Additionally, affixing the cover completely around the dust jacket is cumbersome and time consuming and may not provide a pleasing appearance. Moreover, since the aforementioned methods are not permanently affixed to the dust jacket, the covers tend to become dislodged from the dust jacket, thus defeating the benefit of having a cover.

It is clear that there is a need in the art for a cover to protect dust jackets for bookcovers that can be easily applied. There is also a need in the art for a cover that can be applied to various widths and lengths of dust jackets without using an excessive amount of material. Furthermore, there is a need to provide covers for dust jackets that can be supplied in rolls or in precut pieces.

DISCLOSURE OF INVENTION

In light of the foregoing, it is a first aspect of the present invention to provide a self-sealing cover for a dust jacket.

Another aspect of the present invention is to provide a self-sealing cover for a dust jacket that is easily affixed thereto.

Still a further aspect of the present invention is to provide a self-sealing cover for a dust jacket that can be sized to varying widths and lengths of a dust jacket.

An additional aspect of the present invention is to provide a self-sealing cover for a dust jacket that does not use an excessive amount of covering material.

Yet another aspect of the present invention is to provide a self-sealing cover for a dust jacket that can be provided either in rolls or in single precut pieces.

A further aspect of the present invention is to provide a self-sealing cover for a dust jacket in roll form where the self-sealing cover is self-wound.

The foregoing and other aspects of the invention which shall become apparent as the detailed description proceeds, are achieved by a cover for a dust jacket, including a film having an exterior surface and an interior surface, at least one paper strip having selectively disposed thereon a pressure sensitive adhesive that is partially affixed to either the exterior surface or the interior surface, and at least one release liner selectively disposed on the remaining pressure sensitive adhesive that is not affixed to either the exterior surface or the interior surface.

The present invention also provides a method for affixing a cover to a dust jacket comprising the steps of providing a cover that is at least as long as that of a dust jacket, positioning the dust jacket onto the interior of the cover, folding both edges onto the dust jacket so as to expose pressure sensitive adhesive material on both edges to the interior of the dust jacket, and depressing each edge of the cover onto the dust jacket so as to fixedly secure the cover to the dust jacket.

BEST MODE FOR CARRYING OUT THE INVENTION

Figure 1:
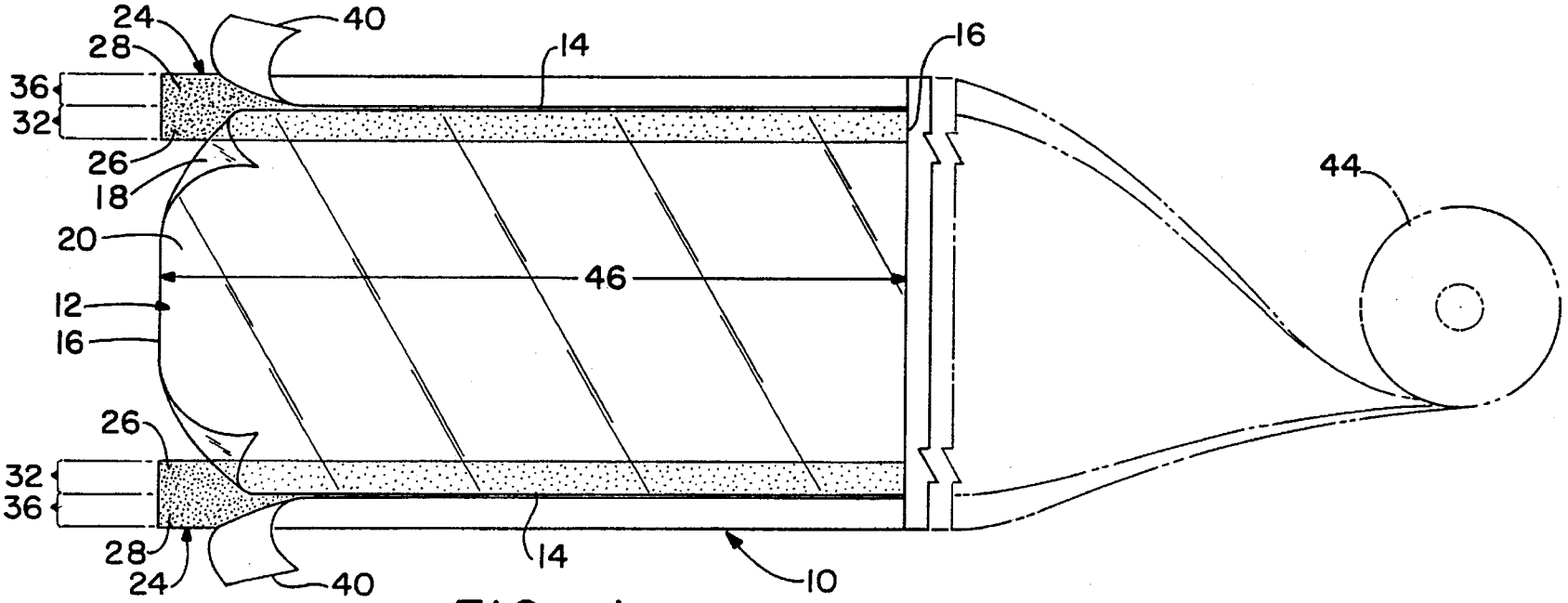
FIG. 1 is a plan view of a self-sealing cover for a dust jacket drawn from a roll shown in elevational view according to the present invention.

Referring now to the drawings and more particularly to FIG. 1, it can be seen that a self-sealing cover for a dust jacket is designated generally by the numeral 10. Generally, the cover 10 comprises a film 12 with an adhesive backed paper strip 24 on each edge. Specifically, the cover 10 comprises a film 12 which in the preferred embodiment is a clear polyester material. Of course, other clear polymeric materials such as polypropylene or vinyl may be employed. Extending along both longitudinal sides of the film 12 is an edge portion 14. Likewise, the film 12 has an end 16 along the entire latitudinal width thereof. Furthermore, the film 12 has an exterior surface 18 opposite an interior surface 20.

Figure 2:
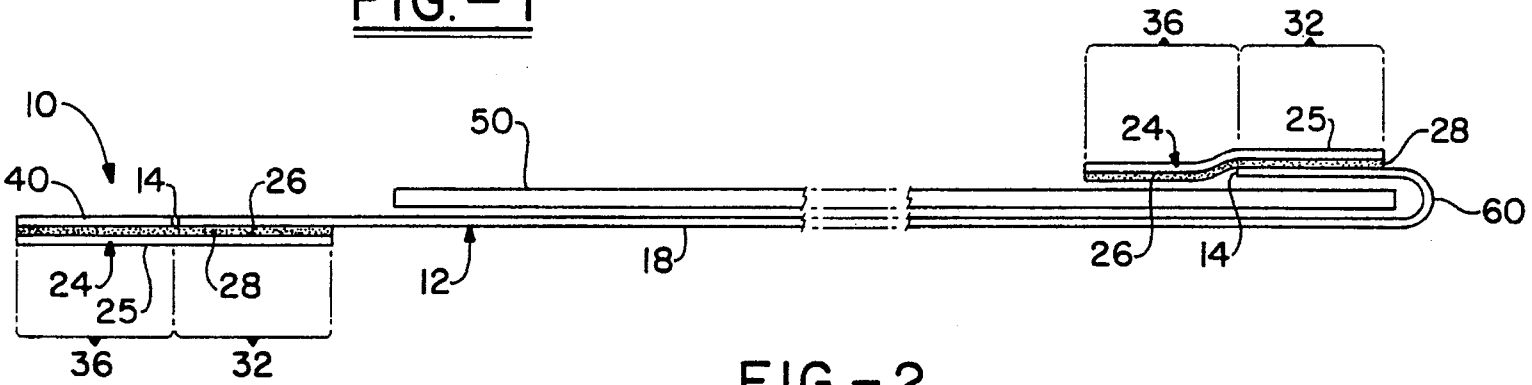
FIG. 2 is a greatly enlarged end elevational view of the self-sealing cover according to the present invention disposed around a dust jacket.

As shown in FIG. 2, disposed along both edge portions 14 is a paper strip 24. Each paper strip 24 has an exterior side 25 and an adhesion side 26. The adhesion side 26 has substantially disposed thereon a pressure sensitive adhesive layer 28. The adhesion side 26 has a film portion 32 that is complementary with a strip portion 36. In other words, the adhesive layer 28 on the film portion 32 functions to bond the paper strip 24 to the exterior surface 18 of the film 12. The strip portion 36, which is that portion of the adhesion side 26 that is not affixed to the film 12, has disposed thereon a selectively removable release liner 40. It should be appreciated that the release liner 40 is coated with a lubricant such as silicone that will allow the release liner to be easily removed from the adhesive layer 28. It should further be appreciated that the only manner in which the release liner 40 is removed from the strip portion 36 is by exerting an upward separating force thereto.

Those skilled in the art will appreciate that the thickness of the respective edge portions 14, with their respective paper strips 24 attached thereto, are substantially equivalent. As such, FIG. 1 shows that the film 12 is easily configured into a cylindrical roll 44 for easy storage and for allowing the film to be unrolled and cut to a predetermined length 46.

Referring again to FIG. 2, it can be seen that a dust jacket 50 is positioned lengthwise along the cover 10 which is then folded at fold line 60 to provide a first crease substantially parallel with the edge portion 14. The release liner 40 is then lifted up and removed from the strip portion 36 so as to expose the adhesive layer 28. The paper strip 24 is then folded over and pressed against the back surface of the dust jacket 50 such that the strip portion 36 is adhesively bonded thereto. In a similar fashion, the opposite edge portion 14 is folded so as to provide a crease that is substantially parallel with the fold line 60. The opposite edge portion 14 is then slightly lifted so as to allow the second release liner 40 to be lifted up and removed from the strip portion 36. The exposed adhesive layer 28 of the adhesion side 26 is then pressed against the interior surface of the dust jacket 50 so as to adhesively bond the other paper strip 24 thereto.

Figure 3B:
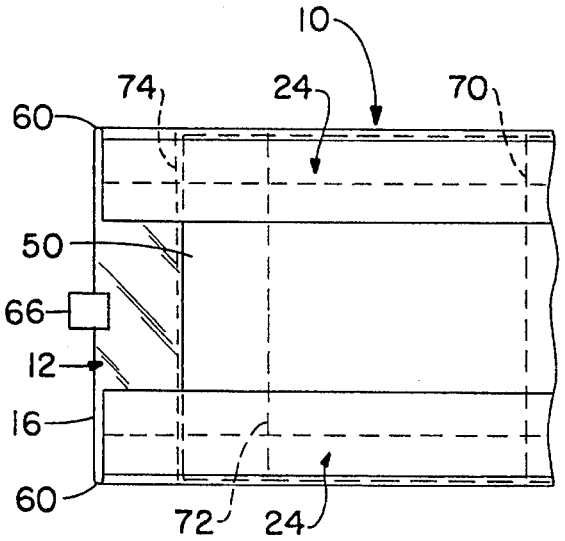
FIGS. 3A and 3B respectively show plan views of a self-sealing cover cut to length and affixed to a dust jacket according to the present invention and a self-sealing cover cut to an extended length so as to completely enclose the dust jacket and is affixed thereto according to the present invention.
Figure 3A:
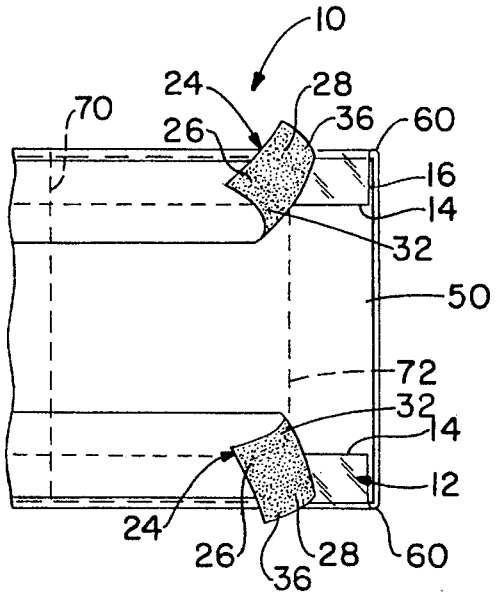

FIG. 3A illustrates the appearance of one end of the finished cover 10 when the film 12 is cut to the same length as the dust jacket 50. Of course, when the film 12 is cut to size from a longer length of film or cut to length off of a roll 44 both ends 16 of the film are flush (even) with the dust jacket 50. It will be appreciated that the dust jacket 50 has spine folds 70 and flap folds 72 that correspond to their respective positioning on a bookcover (not shown). Cover 10 is then affixed to a dust jacket 50 in the manner described earlier.

FIG. 3B illustrates the appearance of one end of the cover 10 when the length of the film 12 exceeds that of the dust jacket 50 at end 16. Of course, in this embodiment both ends 16 of the film are longer than the dust jacket 50. As such, the film 12 has an end fold 74 that corresponds to the length of the dust jacket 50. The extended end 16 is folded over and secured with adhesive tape 66 to the back surface of the dust jacket 50. It should be appreciated that the folded end 16 functions to protect the otherwise exposed edges of the dust jacket 50.

Figure 4:
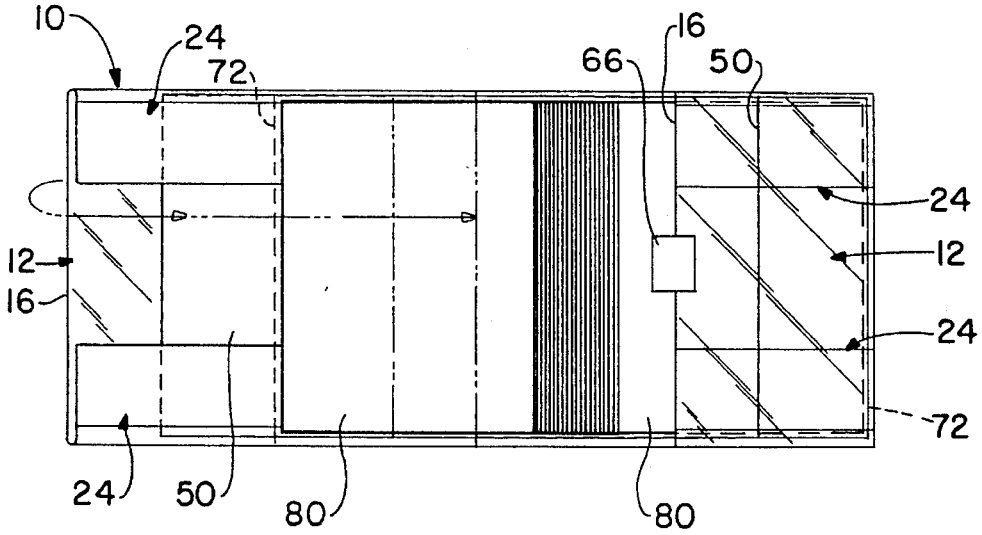
FIG. 4 is a back elevational view of a self-sealing cover cut to a length exceeding that of the dust jacket and then folded over and secured to a bookcover.

Referring now to FIG. 4, it can be seen that the cover 10 may also be secured to a bookcover 80. As in the prior example, the cover 10 extends past the dust jacket 50 at extended end 16. However, instead of affixing the cover 10 to the interior of the dust jacket 50, the cover is affixed to the bookcover 80. The left side of FIG. 4 shows the cover 10 with the extended end 16 that is folded at flap fold 72 onto the bookcover 80. The right side of FIG. 4 shows the extended end 16 affixed to the bookcover 80 with a piece of adhesive tape 66. It should be appreciated that this embodiment prevents the dust jacket 50 from coming loose from the bookcover 80, thereby providing additional protection thereto.

It is apparent from the description presented above that the cover 10 is easily applied to any width or length dust jacket 50. As such, only a few basic width sizes of the cover 10 need to be stored to accommodate a majority of the different size dust jackets available. For example, where the film 12 has a dimension of nine inches between the paper strips 24, which have a width of two inches apiece, the cover 10 can be used on a dust jacket ranging in width from five and one-half inches to nine inches. In the above example, where the dust jacket 50 is only five and one-half inches in width, the second strip portion 36 is affixed to the first exterior side 25 of the paper strip 24 instead of the interior surface of the dust jacket 50. A further benefit of the paper strips 24 are that they provide "body" or substance for improving the handling of the cover 10, which otherwise comprises a dear thin polymeric film including but not limited to polyester, polypropylene or vinyl.

Those skilled in the art will appreciate that the self-adhering feature of the cover 10 reduces the amount of adhesive tape that the librarian is required to use with other types of covers for dust jackets. Furthermore, by securing the cover 10 directly to the dust jacket 50, the likelihood that the dust jacket will come loose and frayed is greatly reduced. Furthermore, the cover 10 is either provided in the form of a cylindrical roll 44 or in pre-cut single pieces, facilitating storage and reducing cost and waste.

Figure 5:
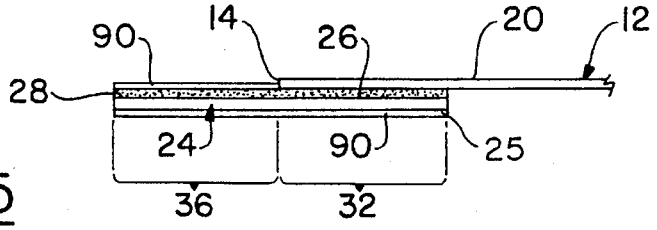
FIG. 5 is a partial end elevational view of a self-sealing cover without a release liner such that the cover is self-windable into roll form.

In order to provide a further convenience to the librarian or other user of the present invention, the cover 10 may be provided in a roll form 44 wherein the release liner 40 is not provided. To accomplish this variation of the preferred embodiment as shown in FIG. 5, the strip portion 36 of the paper strip 24, which has adhesive layer 28 disposed thereon, and the exterior side 25 of the paper strip 24, are both treated with a release material 90, such as silicone. By treating both the exterior side 25 and the strip portion 36 of the paper strip 24 with a release material 90, the cover 10 is self-windable. In other words, the cover 10 is detachably affixed to itself in roll form in much the same way that masking tape is detachably affixed to itself. As such, when the cover 10 is in the form of a roll 44, the exterior side 25 is detachably adhered to the strip edge 36 until the roll is unwound. By eliminating the release liner 40, the diameter of the roll 44 is reduced and the number of steps required to affix the cover 10 to the dust jacket is also reduced.

Thus, it can be seen that the objects of the invention have been satisfied by the structure presented above. It should be apparent to those skilled in the art that the objects of the present invention could be practiced with any size dust jacket. While the preferred embodiment of the invention has been presented and described in detail, it will be understood that the invention is not limited thereto or thereby. Particularly, various materials and configurations may be used in the construction of the invention to meet the various needs of the end user. Accordingly, for appreciation of the true scope and breadth of the invention, reference should be made to the following claims.

What is claimed is:

1. A cover for a dust jacket which has a front surface and a back surface with edges therebetween, comprising:

a film having an exterior surface and an interior surface, said interior surface covering the entire front surface of the dust jacket;

at least one paper strip having selectively disposed thereon a pressure sensitive adhesive that is partially affixed to a longitudinal edge of one of said exterior surface and said interior surface; and a release material selectively disposed on any remaining pressure sensitive adhesive not affixed to one of said exterior surface and said interior surface whereupon said remaining pressure sensitive adhesive is securable to the back surface of the dust jacket.

2. A cover for a dust jacket according to claim 1, wherein said release material is silicone.

3. A cover for a dust jacket according to claim 2, wherein said film comprises a substantially clear polymeric material.

4. A cover for a dust jacket according to claim 3, wherein said film comprises polyester.

5. A cover for a dust jacket according to claim 3, wherein said pressure sensitive adhesive is completely disposed on one side of said paper strip.

6. A cover for a dust jacket according to claim 5, wherein said pressure sensitive adhesive side of each said paper strip has a film edge that is secured to said film and a strip edge that receives said release material.

7. A cover for a dust jacket according to claim 6, wherein said film has spaced apart longitudinal edges, each said longitudinal edge is bonded to said film edge by said pressure sensitive adhesive.

8. A cover for a dust jacket according to claim 7, wherein said strip edge has disposed thereon said release material.

9. A cover for a dust jacket, comprising:

a film having spaced apart longitudinal edges, said film having an exterior surface and an interior surface that covers a front surface of a dust jacket;

a pair of paper strips, each said paper strip having an exterior side and an adhesion side having a pressure sensitive adhesive disposed thereon, said adhesion side having a film edge bonded to only a respective said longitudinal edge and a strip edge; and a pair of release liners, each said release liner correspondingly disposed on one of said strip edges whereupon removal of said pair of release liners, each said adhesion side of said pair of paper strips is securable to only a back surface of the dust jacket to enclose the longitudinal edges of the dust jacket.

10. A cover for a dust jacket according to claim 9, wherein said release liner has a lubricant disposed thereon so as to prevent permanent bonding thereof to said strip edges.

11. A cover for a dust jacket according to claim 10, wherein said film comprises a substantially clear polyester material.

12. A cover for a dust jacket according to claim 11, wherein said longitudinal edges are of equal thickness such that said cover is rollable into a substantially cylindrical form.

13. A cover for a dust jacket according to claim 11, wherein said cover is cut to a predetermined length.

14. A method for affixing a cover to a dust jacket which has a front surface, a back surface and opposed ends, comprising the steps of:

providing a cover which comprises a film having spaced apart longitudinal edges, said film having an exterior surface and an interior surface, a plurality of paper strips having an exterior side and an adhesion side having a pressure sensitive adhesive disposed thereon, said adhesion side having a strip edge and a film edge bonded to said exterior surface only at said longitudinal edge, and a release liner correspondingly disposed on each of said strip edges;

determining the length of said dust jacket;

providing a length of said cover at least as long as said dust jacket;

positioning the front surface of said dust jacket onto said interior surface;

removing one of said release liners from one of said strip edges to expose said pressure sensitive adhesive;

folding one of said longitudinal edges onto said dust jacket;

pressing said exposed strip edge so as to bond said paper strip to only a portion of the back surface of said dust jacket;

removing the other of said release liners from the other of said strip edges to expose said pressure sensitive adhesive;

folding the other of said longitudinal edges onto said dust jacket; and pressing said exposed strip edge so as to bond said paper strip to only a portion of the back surface of said dust jacket.

15. A method according to claim 14, wherein said longitudinal edges are of equal thickness such that said cover is rollable into a substantially cylindrical form.

16. A method according to claim 15, wherein the step of providing a length of said cover includes unrolling said cover from said cylindrical form, and cutting said cover to a length as least as long as said dust jacket.

17. A method according to claim 16, wherein said film comprises a substantially clear polyester material.

18. A method according to claim 16, wherein the method further comprises the steps of:

folding any extra length of said cover over the opposed ends and on to the back surface of said dust jacket; and affixing said extra length to the back surface of said dust jacket.

19. A method according to claim 17, wherein the method further comprises the step of:

affixing any extra length of said cover to a bookcover which receives said dust jacket.

* * * * *